United States Patent [19]

Linzee et al.

[11] 4,244,567

[45] Jan. 13, 1981

[54] SPACE TUMBLER

[75] Inventors: George H. Linzee, 25 Bayview Ave., E. Setauket, N.Y. 11733; Richard Compton, Aspen, Colo.

[73] Assignee: George H. Linzee, East Setauket, N.Y.

[21] Appl. No.: 102,255

[22] Filed: Dec. 10, 1979

Related U.S. Application Data

[63] Continuation of Ser. No. 911,806, Jun. 2, 1978, abandoned.

[51] Int. Cl.[3] ..... A63G 1/12

[52] U.S. Cl. ..... 272/33 R; 272/113; 272/115

[58] Field of Search ..... 272/33 R, 33 A, 33 B, 272/1 R, 1 B, 1 E, 36, 113, 56, 109, 93, 94, 96, 110, 114, 115, 126, 127, 134, 139, 143, 145, 28 R, 51; D21/193, 235, 240, 242, 243, 245, 247, 249, 191

[56] References Cited

U.S. PATENT DOCUMENTS

| | | | |
|---|---|---|---|
| 87,285 | 2/1869 | Ott | 280/206 |
| D. 198,801 | 8/1964 | Mitchell | D21/191 |
| D. 198,923 | 8/1964 | Mitchell | D21/191 |
| 1,901,964 | 3/1933 | Haskell | 272/113 |
| 1,927,682 | 9/1933 | Edwards | 272/33 R |
| 1,979,844 | 11/1934 | Rouenville | 272/33 A |
| 3,083,037 | 3/1963 | Gordon et al. | 272/1 A X |
| 3,145,990 | 8/1964 | Prouty | 272/33 A |
| 3,197,202 | 7/1965 | Tieman | 272/33 R |
| 3,197,203 | 7/1965 | Tieman | 272/33 R |
| 3,290,057 | 12/1966 | Turner | 280/206 |
| 4,076,235 | 2/1978 | Risberg, Jr. | 272/33 A |

FOREIGN PATENT DOCUMENTS

| | | | |
|---|---|---|---|
| 2100565 | 7/1972 | Fed. Rep. of Germany | 272/1 B |
| 985069 | 3/1965 | United Kingdom | 272/33 A |

*Primary Examiner*—Richard C. Pinkham
*Assistant Examiner*—Arnold W. Kramer
*Attorney, Agent, or Firm*—Eisenman, Allsopp & Strack

[57] ABSTRACT

An exercising device for gymnasium or playground structurally designed to support an occupant in a partially reclining position. The structure is basically conical and includes a personal support area surrounded by a structure support area that is designed for contact with the ground or floor surface. Suitable means are provided within the conical structure for the occupant to position his hands and feet so that the unit may be thereafter moved in a rotational fashion by shifting the center of gravity of the unit-occupant combination.

7 Claims, 10 Drawing Figures

SPACE TUMBLER

This is a continuation of copending application Ser. No. 911,806 filed June 2, 1978 and since abandoned.

BACKGROUND OF THE INVENTION

1. Field of the Invention

The invention relates to an exercise and/or recreational device; and more particularly to apparatus suitable for gymnasium or playground use and adapted to move in response to selective body movements of a user.

2. Description of the Prior Art

Apparatus used for exercise and recreation in gymnasiums and playgrounds must be extremely strong in order to endure the physical abuse to which it is subjected. Such apparatus must frequently bear not only the weight of full grown persons; it must also accept without damage unusually high impacts during its employment. Where the apparatus is left out in a playground it must be at least weather resistant and preferably require no maintenance.

Appropriate prior art for the present invention includes the familiar "monkey bars" and also the manually activated horizontal carrousels adapted for rotation about a center pivot and arranged to receive one or more peripherally seated people.

The riding devices disclosed in U.S. Pat. Nos. 3,084,935, 3,145,990, and 3,649,007 are somewhat more relevant than either monkey bars or carrousels in that they utilize an important principle of the present invention; namely, they are adapted to operate with two points in contact with a planar surface in order to yield rotary and translatory motion when a rider modifies his body weight to change the center of gravity of the unit-person combination. U.S. Pat. Nos. 3,197,202 and 3,197,203 are also of interest because they illustrate a unit of generally conical form within which a rider may position himself in order to ultimately achieve head over heels or rotational motion. U.S. Pat. No. 3,460,828 has relevance because it too discloses certain embodiments that are conical in form and which can be positioned on their side in order horizontally or nearly horizontally support an occupant capable of generating random motion by physical changes in his position.

While believed relevant, each of these existing and prior recreational and/or exercising devices exhibits a number of limitations in design, durability, use or flexibility. They are not all equal strong or weather resistant and in many instances they are severely limited in the type of movements and use to which they may be subjected.

SUMMARY OF THE PREFERRED INVENTION

The present invention is embodied in a structure or structures specifically designed for rugged physical use and abuse. The various embodiments described hereinafter can be manufactured of heavy structural steel or piping, plastic, or inflatable vinyl, and may be left exposed to the weather without need for paint or other preservative. The structure is sufficiently large and can be confined to a restricted area without fear of theft or dislogement. On the other hand, it is quite restricted in overall size and may be employed within a constricted area.

The invention is designed and employed in a manner to protect the user against injury as a result of falling. In normal usage, the occupant is never more than a few feet from the ground and the structure itself substantially encloses the occupant so that even if he releases his normal grip upon the apparatus, he will simply fall within the apparatus itself and thereby be supported in some position above the ground.

It is an object of the present invention to provide an improved exercising and recreational apparatus.

It is another object of the invention to provide an improved exercising and recreational apparatus suitable for use by persons of all ages and strength.

It is another object of the invention to provide an improved exercising and recreational apparatus that is inherently stationary yet subject to movement under the direct control of its user.

It is another object of the present invention to provide an improved exercising and recreational apparatus that will enclose a user and support him from contact with either the ground or floor at all times.

Yet another object of the invention is to provide an exercising and recreational apparatus that may be positioned in a variety of ways in order to permit use in totally divergent fashions.

Still another object of the invention is to provide an improved exercising and recreational apparatus that will function well within a limited play area, exposed to the weather, and subjected to heavy physical abuse.

In accordance with a preferred embodiment of the invention, there is provided a structure that may be described as "a cone within a cone". The structural elements defining the outer cone are designed for direct contact with a planar surface such as the floor or ground. The structural members defining the inner cone are adapted to contain a user, provide suitable support means for his members, and inhibit the extension of his body or members into possible contact with the aforementioned planar surface. Specific means are provided within the inner cone for securing a user's feet and affording a plurality of hand gripping positions.

The manner in which this invention achieves the above cited objects, the numerous features of the invention, and an understanding of its use, will be apparent from the following detailed description of several preferred embodiments made in conjunction with the accompanying drawings.

BRIEF DESCRIPTION OF THE DRAWINGS

FIG. 1 schematically illustrates a unit resting on its side and viewed from the base end with a person suspended in normal position. FIG. 2 is a side elevation view of such a schematically depicted device, again showing the person supporting himself within the unit.

FIG. 10 shows another embodiment of the invention suitable for manufacture with vinyl materials or the like.

DESCRIPTION OF THE PREFERRED EMBODIMENT

Figure 1:
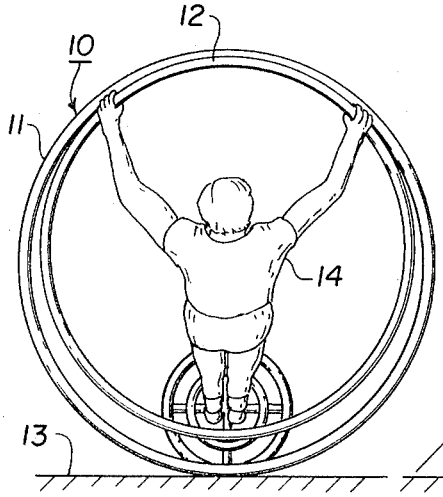
FIGS. 1 and 2 are illustrations showing the concept of the present invention.
Figure 2:
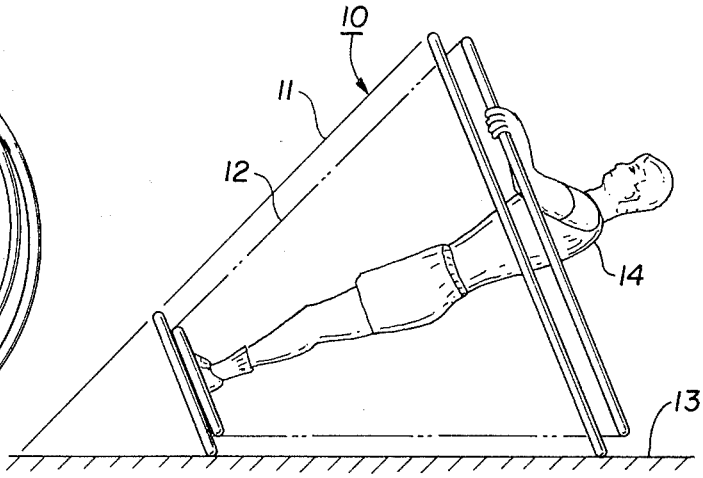
Figure 3:
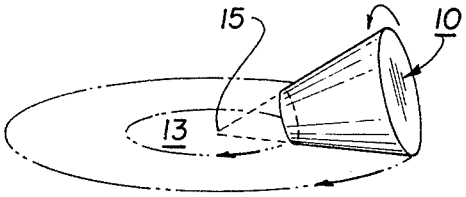
FIG. 3 is a schematic drawing illustrating the motion as idealized truncated cone will experience when rotated about its axis.

FIGS. 1, 2, and 3 will help to understand the manner in which the invention can be used in its fundamental function as a space tumbler. As seen in FIGS. 1 and 2, the apparatus 10 consists of an outer cone 11 surrounding an inner cone 12. The function of the outer cone 11 is to rest upon the substantially planar surface of either a floor or the ground 13. The user 14 is positioned within inner cone 12 with his feet toward the apex of the cone and his head toward its base. The user's feet are preferably secured to their position (though not necessarily) and he supports his body slightly above a horizontal position by grasping onto a portion of the inner cone 1.

In order to effect movement of apparatus 10, the user merely shifts his center of gravity so that it is not aligned with the line contact of the apparatus with planar surface 13. Such shifting will clearly result in rotational movement of apparatus 10 in order to effect realignment of the center of gravity with the line of contact. FIG. 3 schematically shows that a shifting of weight toward the left will result in rotation of apparatus 10 in a counter-clockwise direction and furthermore in a circular movement of the entire apparatus in a generally clockwise direction about a center 15. Center 15 is the effective apex of the cone.

It should be apparent that one is not restricted by a specific conical structure in order to achieve the functions and results discussed in conjunction with FIGS. 1 through 3. In fact, the structure may be a truncated cone or may simply consist of elements which sufficiently define a cone to achieve the desired results. This is the nature of the preferred embodiment illustrated in FIGS. 4 through 7. The idealized condition suggested by the schematic of FIG. 3 would exist only if a perfect cone and perfectly flat surface were involved. When one employs a truncated cone it may be preferable to secure the cone by means of a chain or similar device to a swivel or pivot point at 15 that will permit this movement and in fact assure it.

FIGS. 4 through 7 show a particularly effective embodiment of the invention that may be utilized not only as a space tumbler, but also as a climbing structure. It is fabricated by pipes or similar structural members. Four similar elements 25, 26, 27 and 28 are arranged in quadrature and fastened by welding or other appropriate rigid bonding to a base ring 21 and upper ring 23.

Members 25, 26, 27 and 28 are designed upon interconnection with base ring 21 and a position within upper ring 23 to define an inner cone 30 having an apex 32. Cross braces 33, 34 are provided for interconnection of the members 25–28 with the upper ring 23. A hooked portion 35 at the bottom of each of the members 25–28 extends beyond the defined cone 30. An outer ring 22 is connected to the end of the hooked portion so that lines extended between the periphery of ring 22 and upper ring 23 define an outer cone 29 having an apex at 31.

Typical member 25 contains a hooked portion 35, extending portion 36 positioned in order to fall within the limitations of inner cone 30, extending portion 37 substantially parallel to base ring 21, extending portion 38 again falling within the periphery of inner cone 30, extending portion 39 substantially parallel to base ring 21, and extending portion 40 falling within the periphery of inner cone 29. The extremity of hooked portion 35 is connected to the outer base ring 22 and the extremity of portion 40 is connected to cross brace 34 intermediate inner ring 24 and outer ring 23.

Figure 4:
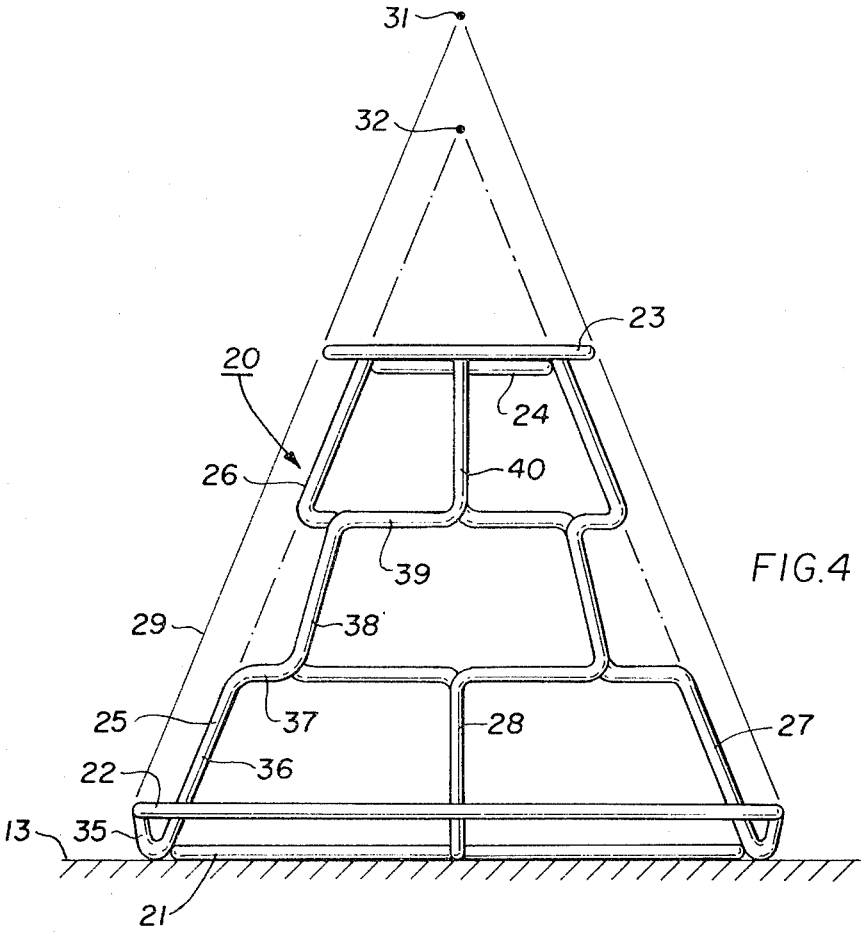
FIG. 4 is an elevation of a preferred embodiment of the invention positioned on its base for use as a climbing structure.
Figure 5:
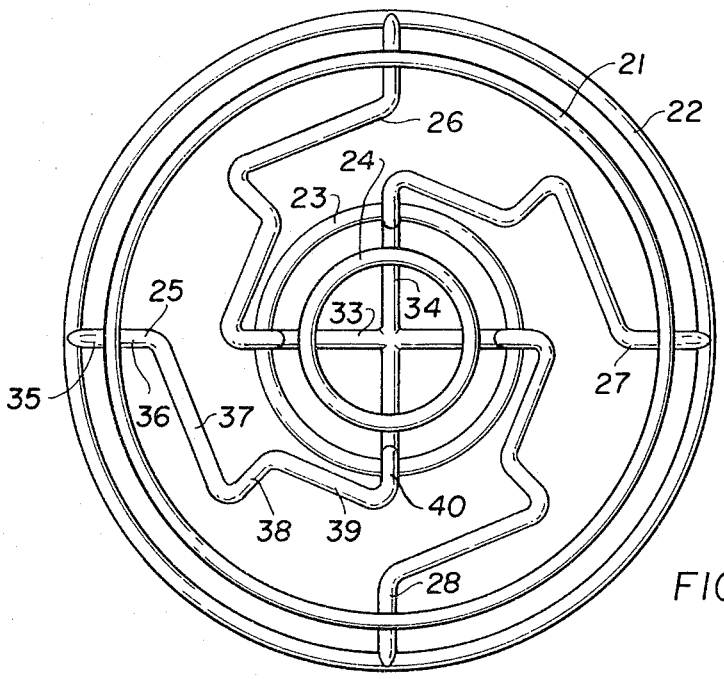
FIG. 5 is a view of said preferred embodiment of the invention from the base.
Figure 6:
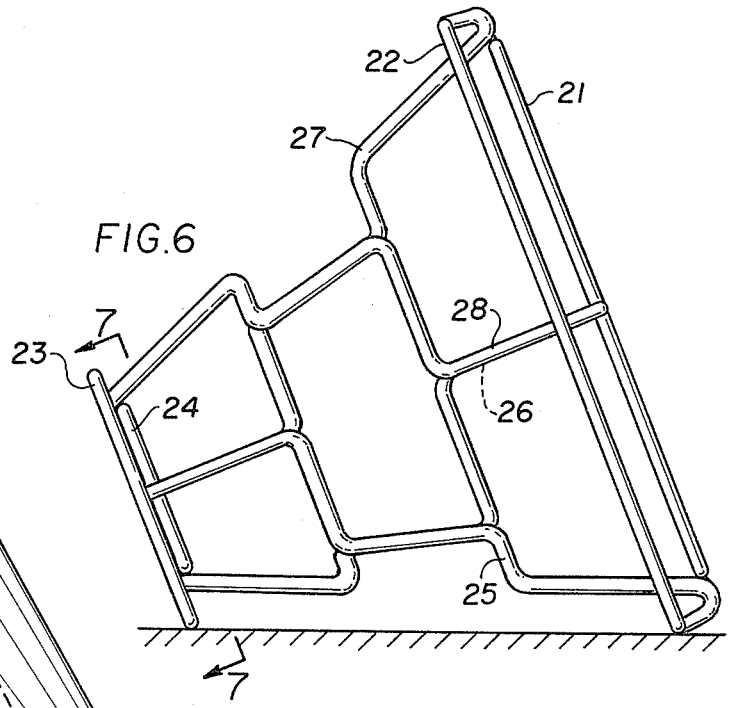
FIG. 6 is an elevation view of said preferred embodiment when it is positioned on its side for use as a space tumbler.

A typical embodiment of the invention positioned as shown in FIG. 4, may stand five feet high and have a diameter at the base of approximately six feet. These dimensions are approximate, but would yield a structure suitable for use by individuals of all sizes. When positioned as shown in FIG. 4, the structure may be used for climbing. On the other hand, when positioned as shown in FIG. 5 or 6, it is suitable for the space tumbling function.

Figure 7:
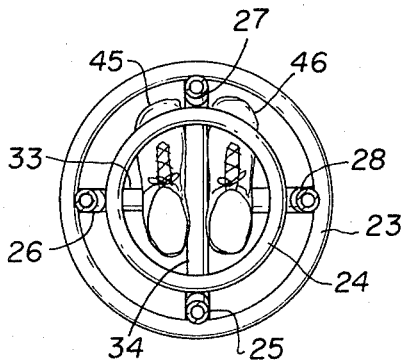
FIG. 7 is a cross-sectional view taken along the lines 7—7 of FIG. 6 and illustrates the manner in which a user's feet may be supported.

FIG. 7 illustrates the relative dimensioning of inner ring 24 and cross bars 33, 34, in order to yield a foot securing area. The shoes 45, 46 schematically illustrate the manner in which a user will tuck his toes under ring 24 in order to withstand pressures as he shifts his weight during tumbling.

In use, a rider positions his feet as shown in FIG. 7 and places his hands along base ring 21 supporting his body substantially along the axis of the cone. Since the cone is laying upon the ground or similar surface it makes point contact on the periphery of outer rings 22, 23 and any slight shift of the user's body will cause a corresponding rotation of the cone. A skilled rider is capable of stopping the cone in any position either when he is looking upward or downward and stops moving momentum with his body over the center of gravity (i.e. where structure rests in contact with the ground).

Several aspects of this structure are important to note. First, by virtue of the inner-outer cone concept, the rider is completely encased within an inner cone and his members are restrained from contact and hence crushing between the unit and the ground. The relative dimensions of the inner and outer cones determines the clearance between the occupant's members and the ground. The unit is built of sufficiently heavy weight materials to assure rigidity and also to permit its static positioning as shown in FIG. 6 without the possibility of tipping when a rider is mounted within. On the other hand, when it is desired, the application of a suitable turning torque will permit readjusting the position of the cone to the condition discussed earlier in connection with FIG. 4.

Figure 8:
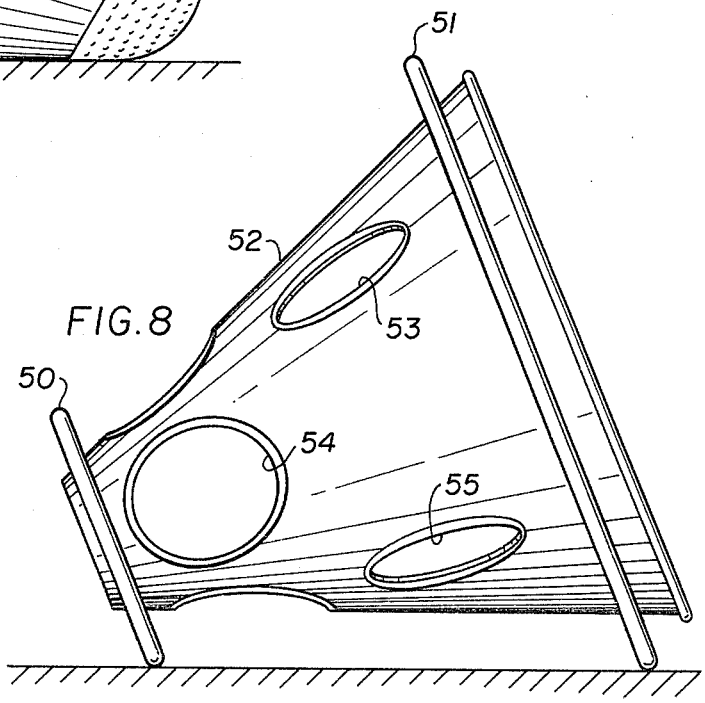
FIG. 8 shows an embodiment of the invention wherein the inner cone is substantially encased by sheet material.

The embodiment of FIG. 8, partakes of features from each of the previously described embodiments. It includes metal pipe or reinforced rings 50, 51 defining the outer cone and a substantially solid sheet material 52 defining the inner cone. The sheet material may be of heavy plastic and preferably includes holes 53, 54, 55 to provide vision, access and climbing potential. Suitable structure for grasping and foot support is provided within the inner cone. The possibility of slipping through the structure is greatly reduced by use of this type of sheet material and by avoiding holes near the outer rings, the occupant is inhibited from grabbing onto these rings.

Figure 9:
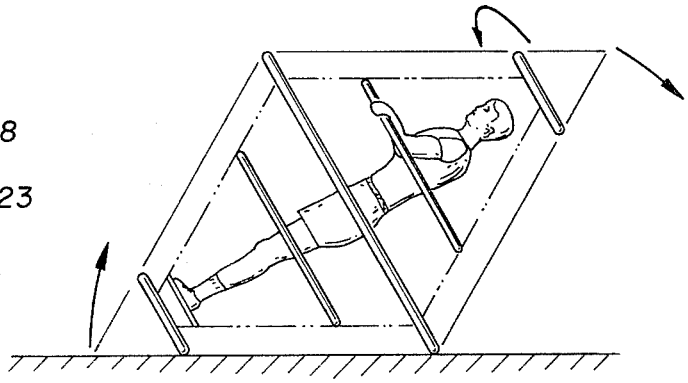
FIG. 9 is a schematic illustration of another embodiment of the invention utilizing a pair of cones with bases interconnected.

FIG. 9 illustrates a further embodiment of the invention. This is a conceptual illustration and illustrates the utilization of a pair of space tumbler cones in base-tobase relationship. In this embodiment, the cones are smaller than in the embodiment described above and by shifting weight from end to end, a rider is able to tumble from one apex to the other as well as continually effect the rotational tumbling achieved by lateral weight shifts.

Figure 10:
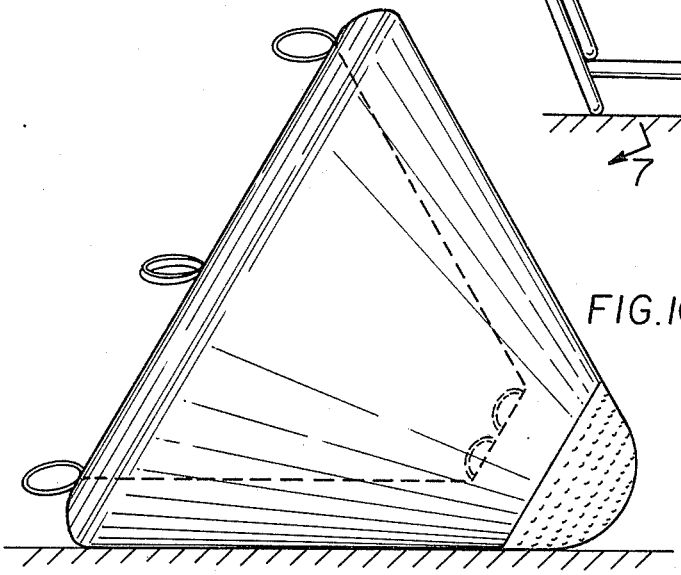

FIG. 10 is a conceptual illustration of yet another embodiment of the invention. In this embodiment, the structure is surrounded by a vinyl or similar material in order to totally enclose the unit. If the skeletal structure which affords the necessary rigidity is too light with this embodiment, the apex portion is provided with weighting or a central swivel device connected to the ground, in order to assure stability. This embodiment adds the possibility of rotation about the apex with suitable body shifts of the rider.

In addition to the preferred embodiment of the invention, several alternative embodiments have been described. Still other modifications will be apparent to those skilled in the art. It is intended to cover all aspects of the invention and any modifications coming within the spirit and teachings thereof should be embraced by the appended claims.

What is claimed is:

1. An exercising device for supporting a rider above the ground comprising: structural members defining inner and outer interconnected cones displaced from one another along a common axis; said outer cone being defined by different diameter rings adapted to rest upon the ground and having said axis at their center; and said inner cone being defined by a plurality of struts connected between said rings, each of said struts including substantially straight longitudinal portions extending along lines that converge on said axis and at least two substantially straight transverse portions extending parallel to the plane of said rings, said transverse portions interconnecting said longitudinal portions and lying within the perimeter of said inner cone.

2. An exercising device in accordance with claim 1, including graspable means connected to said struts toward the base of said inner cone to permit said rider to support his body weight by holding said graspable means with his hands.

3. An exercising device in accordance with claim 2, including means connected to said struts towards the apex of said inner cone to secure said rider's feet.

4. An exercising device in accordance with claim 3, wherein said means for securing a rider's feet comprises a further ring centered on said axis and having a diameter smaller than the diameter of the upper ring defining said outer cone and a pair of orthogonally disposed struts positioned below said further ring, said struts being disposed to support the bottom of the rider's feet and said further ring being disposed to contact the top of the rider's feet.

5. An exercising device in accordance with claim 2, wherein said graspable means comprises a further ring centered on said axis and having a diameter smaller than the diameter of the base ring defining said outer cone.

6. An exercising device in accordance with claim 2, including means connected to said struts towards the apex of said inner cone to secure said rider's feet; wherein said graspable means comprises a further ring centered on said axis and having a diameter smaller than the diameter of the base ring defining said outer cone; and wherein said means for securing a rider's feet comprises a further ring centered on said axis and having a diameter smaller than the diameter of the upper ring defining said outer cone.

7. An exercising device in accordance with claim 1, including means for rotatably securing said device to the ground at a position in proximity to the point where said common axis intersects the ground.

* * * * *